US011019968B2

(12) United States Patent
Lubbers et al.

(10) Patent No.: US 11,019,968 B2
(45) Date of Patent: Jun. 1, 2021

(54) VACUUM CLEANER NOZZLE

(71) Applicant: KONINKLIJKE PHILIPS N.V., Eindhoven (NL)

(72) Inventors: Matthijs Hendrikus Lubbers, Lieveren (NL); Jonne Steeman, Hemrik (NL); Klaas Hilverda, Drachten (NL); Bastiaan Johannes De Wit, Groningen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/976,784

(22) PCT Filed: Feb. 25, 2019

(86) PCT No.: PCT/EP2019/054505

§ 371 (c)(1),
(2) Date: Aug. 31, 2020

(87) PCT Pub. No.: WO2019/170442

PCT Pub. Date: Sep. 12, 2019

(65) Prior Publication Data

US 2021/0000314 A1 Jan. 7, 2021

(30) Foreign Application Priority Data

Mar. 5, 2018 (EP) ..... 18160067

(51) Int. Cl.
*A47L 9/02* (2006.01)
*A47L 9/00* (2006.01)
*A47L 9/24* (2006.01)

(52) U.S. Cl.
CPC ..... *A47L 9/02* (2013.01); *A47L 9/009* (2013.01); *A47L 9/242* (2013.01)

(58) Field of Classification Search
CPC ..... A47L 9/02; A47L 9/009; A47L 9/242
See application file for complete search history.

(56) References Cited

U.S. PATENT DOCUMENTS 5,950,275 A * 9/1999 Worwag ..... A47L 9/0416 15/387
7,150,068 B1 * 12/2006 Ragner ..... A47L 5/22 15/340.2

(Continued)

FOREIGN PATENT DOCUMENTS

CN 101099648 1/2008
EP 2064978 6/2009

(Continued)

OTHER PUBLICATIONS

International Search Report and Written Opinion dated Apr. 18, 2019 for International Application No. PCT/EP2019/054505 Filed Feb. 25, 2019.

*Primary Examiner* — Dung Van Nguyen

(57) ABSTRACT

In a vacuum cleaner nozzle (N) comprising one or more rear wheels (RW), a hinge (H3) is arranged to lift all one or more rear wheels (RW) from a floor (F) when a suction tube (ST) connected to the nozzle (N) is rotated around a longitudinal axis of the suction tube (ST), e.g. after the nozzle (N) has been rotated by more than 45° by means of a further hinge (H2) in order to position a relatively short side of the nozzle at the front of the nozzle in the nozzle's motion direction so that the nozzle is able to clean relatively small spaces that could not be entered if a relatively long side of the nozzle is at the front of the nozzle in the nozzle's motion direction. If the one or more rear wheels (RW) comprise at least two rear wheels, the hinge (H3) is arranged for simultaneously lifting the rear wheels (RW) from the floor (F). Preferably, the hinge (H3) is bi-stable, to which end the hinge (H3) may be provided with magnets (M1-2, M3-4) or a bi-stable spring (Continued)

(S) to fix the hinge (H3) either in a first position in which the one or more rear wheels (RW) are arranged to touch the floor (F), or in a second position in which the one or more rear wheels (RW) are arranged to be lifted from the floor (F). A vacuum cleaner advantageously comprises such a nozzle.

20 Claims, 3 Drawing Sheets

(56) References Cited

U.S. PATENT DOCUMENTS

| | | | | |
|---|---|---|---|---|
| 7,979,959 | B2 | 7/2011 | Courtney | |
| 9,568,115 | B2 | 2/2017 | Bianchi | |
| 2017/0215668 | A1* | 8/2017 | Lubbers ..... | A47L 9/0686 |

FOREIGN PATENT DOCUMENTS

| | | |
|---|---|---|
| EP | 2433539 | 3/2012 |
| EP | 2929821 | 10/2015 |
| EP | 3047776 | 7/2016 |
| JP | H10328099 | 12/1998 |
| RU | 2584671 | 5/2016 |
| WO | 2005/110179 | 11/2005 |
| WO | 2014087610 | 6/2014 |
| WO | 2017113505 | 7/2017 |

* cited by examiner

VACUUM CLEANER NOZZLE

CROSS REFERENCE TO RELATED APPLICATIONS

This application is the U.S. National Phase application under 35 U.S.C. § 371 of International Application No. PCT/EP2019/054505 filed Feb. 25, 2019, which claims the benefit of European Patent Application Number 18160067.7 filed Mar. 5, 2018. These applications are hereby incorporated by reference herein.

FIELD OF THE INVENTION

The invention relates to a vacuum cleaner nozzle, and to a vacuum cleaner provided with such a nozzle.

BACKGROUND OF THE INVENTION

U.S. Pat. No. 7,979,959 discloses an accessory for a cleaning appliance includes a head having a housing, a downwardly-directed suction opening in the housing and a neck adapted for attachment to a hose or wand of the cleaning appliance. A rotatable connection is provided between the neck and the head for allowing rotation of the neck relative to the head. A wheel arrangement maneuverably supports the accessory on a surface to be cleaned and is mounted on the neck of the accessory. The wheel arrangement may normally be in contact with the surface to be cleaned, but the point or points of contact between the wheel arrangement and the surface to be cleaned are dependent upon the rotational position of the neck with respect to the head.

EP2929821 discloses a vacuum-cleaner suction tool that has a suction-tool body, a joint tube section, and a wheel section having two wheels. If the nozzle is turned, one wheel is lifted from the floor while the other stays in contact with the floor.

WO2005/110179 discloses an accessory for a cleaning appliance having a head comprising a housing and a downwardly-directed suction opening and a neck adapted for attachment to a hose or wand of the cleaning appliance. A rotatable connection is provided between the neck and the head for allowing rotation of the neck relative to the head, and a wheel arrangement is provided for maneuverably supporting the accessory on a surface to be cleaned. The wheel arrangement is mounted on the neck of the accessory. In a preferred embodiment, the wheel arrangement is normally in contact with the surface to be cleaned, but the point or points of contact between the wheel arrangement and the surface to be cleaned are dependent upon the rotational position of the neck with respect to the head. Again, if the nozzle is turned, one wheel is lifted from the floor while the other stays in contact with the floor.

EP2064978 discloses a floor nozzle for a vacuum cleaner. Again, if the nozzle is turned, one wheel is lifted from the floor while the other stays in contact with the floor.

Known vacuum cleaner nozzles have rear wheels at a rear end of the nozzle, i.e. the end facing a user of the vacuum cleaner in a normal way of operating the nozzle. While these rear wheels are great in moving the nozzle forward and backward in the normal way of operating the nozzle, these rear wheels hamper the nozzle's movement if the user wants to move the nozzle side-wards, i.e. in a direction substantially parallel to the long sides of the nozzle, in order to make the nozzle move into narrow spaces because the relatively small side of the nozzle now becomes the front of the nozzle.

SUMMARY OF THE INVENTION

It is, inter alia, an object of the invention to provide an improved vacuum cleaner nozzle. The invention is defined by the independent claims. Advantageous embodiments are defined in the dependent claims.

One aspect of the invention provides a vacuum cleaner nozzle comprising one or more rear wheels, in which a hinge is arranged to lift all one or more rear wheels from a floor when a suction tube connected to the nozzle is rotated around a longitudinal axis of the suction tube, e.g. after the nozzle has been rotated by more than 45° by means of a further hinge in order to position a relatively short side of the nozzle at the front of the nozzle in the nozzle's motion direction so that the nozzle is able to clean relatively small spaces that could not be entered if a relatively long side of the nozzle is at the front of the nozzle in the nozzle's motion direction. If the one or more rear wheels comprise at least two rear wheels, the hinge is arranged for simultaneously lifting the rear wheels from the floor. Preferably, the hinge is bi-stable, to which end the hinge may be provided with magnets or a bi-stable spring to fix the hinge either in a first position in which the one or more rear wheels are arranged to touch the floor, or in a second position in which the one or more rear wheels are arranged to be lifted from the floor. A vacuum cleaner advantageously comprises such a nozzle.

These and other aspects of the invention will be apparent from and elucidated with reference to the embodiments described hereinafter.

DESCRIPTION OF EMBODIMENTS

A vacuum cleaner nozzle may have one or more rear wheels in the rear of the nozzle for supporting the weight of the vacuum cleaner (i.e. the tube in case of a canister) and enable the steering of the nozzle. Therefore, these rear wheels have grip/friction towards the floor to prevent sliding and uncontrolled behavior. The nozzle may further have front wheels to support the weight of the nozzle, prevent the bottom of the nozzle (soleplate) from touching and scratching the floor, and reduce the motion resistance when moving back and forward. A hinge connects the nozzle to the tube (and vacuum cleaner). The hinge enables that the tube can be tilted up and down and enables the rotation of the nozzle when the suction tube (vacuum cleaner) is rotated. When the nozzle has a very flexible hinge, the nozzle is able to rotate by more than 45°, and preferably more than 60°, or more than 75°, or (close to) 90°. In this rotated position, the nozzle would fit in narrow spaces because the relatively small side of the nozzle becomes now the front of the nozzle. A problem is that in this rotated position, the nozzle cannot be smoothly pushed back and forward because the grippy rear wheels block the movement as the wheels are oriented at an angle to the motion direction. Reducing the friction between rear wheels and floor would allow for the nozzle to be smoothly pushed backward and forward also when it is rotated by more than 45°, but doing so would hamper normal steering behavior because the rear wheels would slide rather than roll over the floor when a user tries to steer the nozzle. Uncontrolled steering behavior would be the result.

In view thereof, in accordance with an aspect of the invention, the rear wheels are lifted when the nozzle is rotated by more than 45°. If the one or more rear wheels comprise more than one rear wheel, not just one rear wheel needs to be lifted as in U.S. Pat. No. 7,979,959, as then still another rear wheel touches the floor and hampers a smooth movement in a direction perpendicular to that rear wheel's orientation; instead, the rear wheels should be lifted simultaneously, so that no rear wheel hampers a smooth movement. Preferably, this is done in combination with features that support the nozzle to smoothly roll or slide over the floor in this direction. Because the nozzle works in a dirty environment, the mechanism to tilt the rear wheels is preferably very robust. One of the main elements is to add an additional hinge point to the hinge.

Figure 1A:
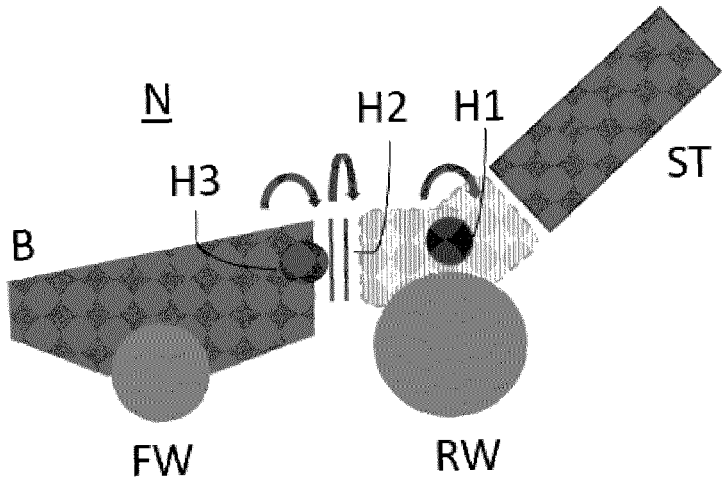
FIGS. 1A-1C and 2 illustrate embodiments of the invention.
Figure 1B:
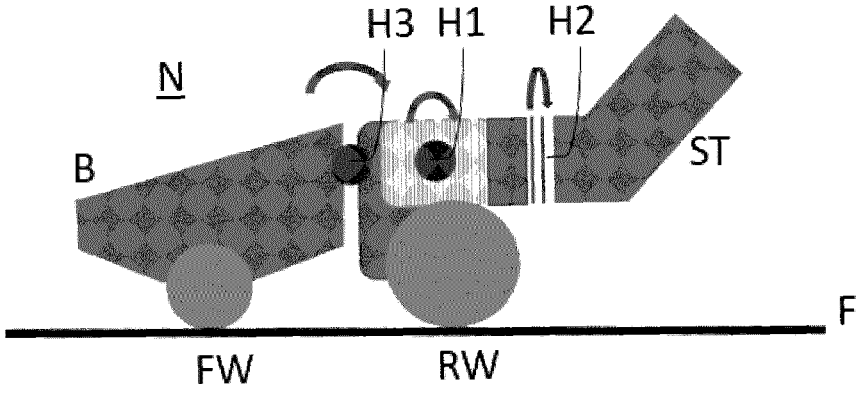
Figure 1C:
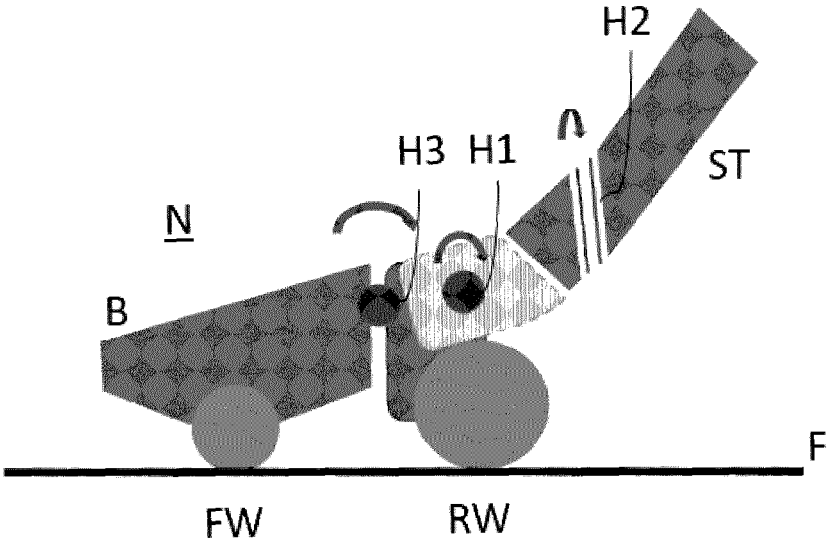

FIGS. 1A-1C illustrates a side view of a vacuum cleaner nozzle N in accordance with embodiments of the invention. The nozzle N has a nozzle body B, front wheels FW, and one or more rear wheels RW. The nozzle N can be connected to a suction tube ST. A first hinge H1 allows for the suction tube ST to move up-down, and a second hinge (H2) allows the nozzle to rotate, whereby the nozzle N can be steered into a desired direction. In accordance with an aspect of the invention, a third hinge H3 is provided that allows the one or more rear wheels RW to be lifted from a floor. Adding this additional hinge H3 enables that the one or more rear wheels RW are lifted when the nozzle rotates by more than 45°, such as more than 60°, or more than 75°, or (close to) 90°. Rotating the suction tube ST (via the handle) will first rotate the nozzle N, and once the nozzle is rotated, the rotation of the suction tube ST will lift the one or more rear wheels RW via the force/torque on the additional hinge H3.

Figure 2:
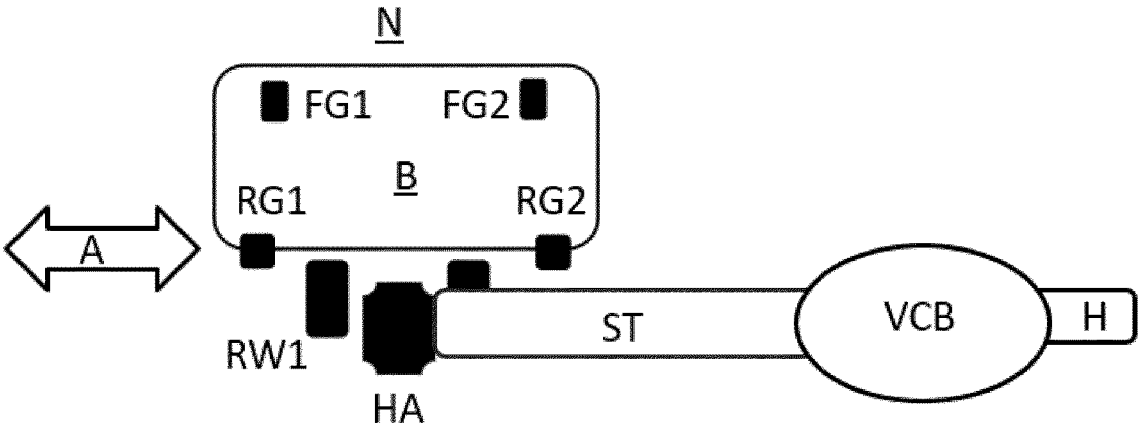

FIG. 2 illustrates a vacuum cleaner provided with a nozzle in accordance with such an embodiment of the invention, when the nozzle has been rotated. FIG. 2 shows a situation in which the nozzle N has been rotated by 90°. In this embodiment, the vacuum cleaner is a stick vacuum cleaner having a handle H, a vacuum cleaner body VCB that houses the fan and dirt container, the suction tube ST, a hinge arrangement HA formed by the hinges H1, H2 and H3 of any of FIGS. 1A-1C, and the nozzle body B. When the nozzle N is rotated by more than 45°, e.g. by 90° as indicated in FIG. 2, and the one or more rear wheels RW are lifted from the floor F, the nozzle N is able to slide on the front wheels FW in a forward direction as indicated by the arrow A. The front wheels FW should be made out of a material that has a low friction coefficient in combination with different floor types. The lower the friction coefficient the more easily the nozzle N moves forward in the rotated position. The only function of the front wheels FW is to support the nozzle N and to ensure that the sole plate does not touch/scratch the floor. Therefore, those front wheels FW can be replaced by gliding elements FG1, FG2. To make the nozzle N slide more stably in the rotated position and to make sure that the sole plate is not touching/scratching the floor, additional gliding elements/wheels RG1, RG2 can be added to the rear of the sole plate.

An optimal setup of components to accommodate the best maneuvering nozzle with the function of moving the vacuum cleaner back and forward when the nozzle is in the 90° rotated position is the following. A nozzle is connected via a hinge arrangement which has three hinges H1, H2, H3, counting ascending from the suction tube side. The first two hinges H1, H2 rotate the nozzle and suction tube, thus enabling steering, and the third hinge H3 lifts the rear wheels (which have sufficient friction to the floor to enable steering) when the nozzle is rotated by more than 45°. The axis of the first hinge H1 is almost parallel to the floor and perpendicular to the axis of the second hinge H2 and the axis of the third hinge H3 which are also parallel to the floor. The axis of the first hinge H1 is parallel to the floor and to the axis of the third hinge H3. The axis of the second hinge H2 is perpendicular to the axes of the first and third hinges H1, H3. The nozzle N is supported by supporting elements in the front of the nozzle N and optionally but preferably also by supporting elements in the rear of the nozzle. These supporting elements can be wheels made out of low friction material like POM, POM+PTFE, HMPE etc. The wheels can alternatively have a layer of fluffy material like velour to prevent the wheels from scratching the floor. The supporting elements can alternatively be caster wheels which rotate always in the direction of movement. These caster wheels radiate the agility of the nozzle. A very simple supporting element can be formed by bristles.

Figure 3A:
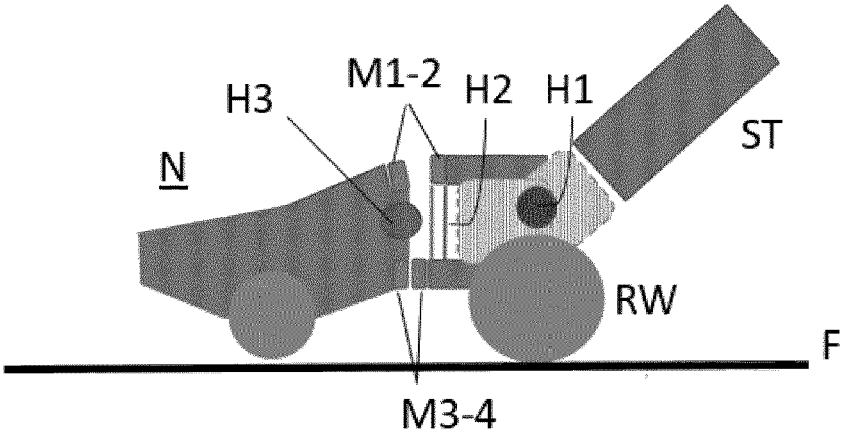
FIGS. 3A, 3B and 4A, 4B illustrate further embodiments of the invention.
Figure 3B:
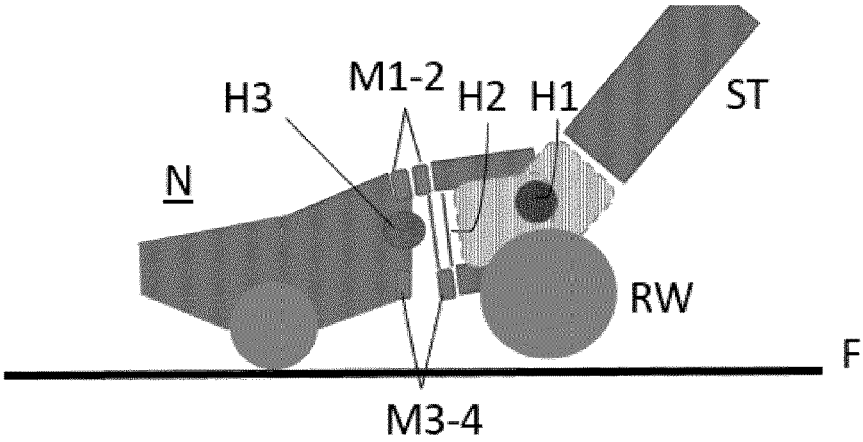
Figure 4A:
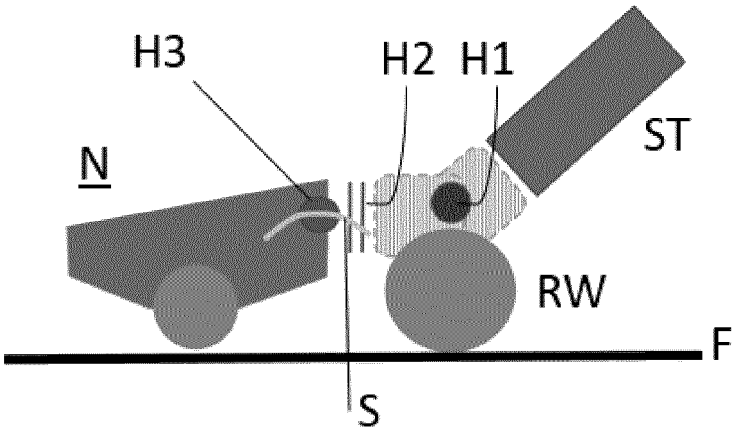
Figure 4B:
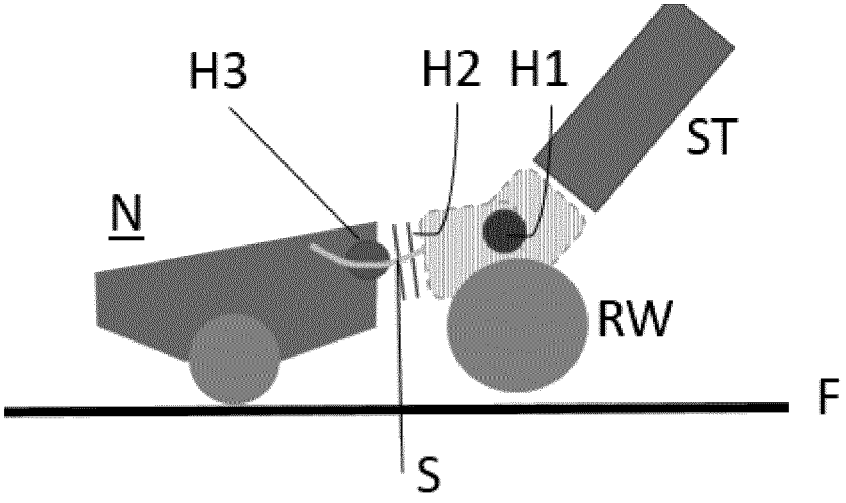

FIGS. 3A, 3B and 4A, 4B illustrate further embodiments of the invention. The additional hinge H3 enables that the one or more rear wheels RW are lifted when the nozzle rotates by more than 45°. Rotating the suction tube (e.g. via the handle H) will first rotate the nozzle N, and once the nozzle N is rotated, the rotation of the suction tube ST will lift the one or more rear wheels RW via the force/torque on the additional hinge H3. To make the nozzle N more stable in the rotated position and prevent the one or more rear wheels RW from dropping and hampering the motion on the floor F, the additional hinge H3 should be bi-stable. This can be done by adding magnets M1-2 and M3-4 as shown in FIGS. 3A, 3B, or by adding a bi-stable leaf spring S in the hinge H3 as shown in FIGS. 4A, 4B. FIGS. 3A and 4A show the nozzle with the one or more rear wheels RW still touching the floor F, while FIGS. 3B and 4B show the nozzle in a second position with the one or more rear wheels RW being lifted from the floor F. Making the hinge H3 bi-stable also has a positive effect on the user experience when the hinge H3 really snaps in the second position.

It should be noted that the above-mentioned embodiments illustrate rather than limit the invention, and that those skilled in the art will be able to design many alternative embodiments without departing from the scope of the appended claims. If the vacuum cleaner is a stick vacuum cleaner with the vacuum cleaner body close to the nozzle, the notion "suction tube" should be understood to be the connection of the vacuum cleaner body to the nozzle. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention may be implemented by means of hardware comprising several distinct elements. In the device claim enumerating several means, several of these means may be embodied by one and the same item of hardware. The mere fact that certain measures are recited in mutually different dependent claims that do not refer to one another does not indicate that a combination of these measures cannot be used to advantage.

The invention claimed is:

1. A vacuum cleaner nozzle comprising:

a suction tube connected to the vacuum cleaner nozzle body, at least two rear wheels, a hinge arrangement comprising:

a first hinge configured and arranged to allow the suction tube to be rotated around a longitudinal axis of the suction tube, a second hinge configured and arranged to allow the vacuum cleaner nozzle body to be rotated in a horizontal plane, and a third hinge configured and arranged to allow all of the at least two rear wheels to be simultaneously lifted from a floor when the nozzle body is rotated by the second hinge in the horizontal plane.

2. The vacuum cleaner nozzle as claimed in claim 1, wherein when the vacuum cleaner nozzle body is rotated by more than 45°, a side of the vacuum cleaner nozzle becomes a front of the vacuum cleaner nozzle in a motion direction of the vacuum cleaner nozzle.

3. The vacuum cleaner nozzle as claimed in claim 1, wherein the third hinge is bi-stable.

4. The vacuum cleaner nozzle as claimed in claim 3, wherein the third hinge is provided with magnets to fix the hinge either in a first position in which the one or more rear wheels are arranged to touch the floor, or in a second position in which the one or more rear wheels are arranged to be lifted from the floor.

5. The vacuum cleaner nozzle as claimed in claim 3, wherein the third hinge is provided with a bi-stable spring to fix the hinge either in a first position in which the one or more rear wheels are arranged to touch the floor, or in a second position in which the one or more rear wheels are arranged to be lifted from the floor.

6. The vacuum cleaner comprising a vacuum cleaner nozzle as claimed in claim 1.

7. The vacuum cleaner comprising a vacuum cleaner nozzle as claimed in claim 1, when once the nozzle is rotated, a corresponding rotation of the suction tube will lift the at least two rear wheels via a force/torque on the third hinge.

8. The vacuum cleaner comprising a vacuum cleaner nozzle as claimed in claim 1, when each of said first and second hinges are arranged to enable steering.

9. The vacuum cleaner comprising a vacuum cleaner nozzle as claimed in claim 1, when the third hinge is arranged to enable lifting of the at least two rear wheels.

10. The vacuum cleaner nozzle as claimed in claim 1, wherein the nozzle is supported by supporting elements at the front of the nozzle body, wherein the supporting elements are selected from the group consisting of: wheels constructed of a low friction material, caster wheels, bristles.

11. The vacuum cleaner nozzle as claimed in claim 1, further comprising at least one front wheel arranged to support the weight of the nozzle and prevent a bottom side of the nozzle from touching and scratching the floor and being further arranged to reduce motion resistance when moving the nozzle back and forth across the floor.

12. The vacuum cleaner nozzle as claimed in claim 1, wherein the suction tube is rotated by the second hinge around the suction tube's longitudinal axis by at least 45°.

13. The vacuum cleaner nozzle as claimed in claim 1, wherein an axis of the first hinge is substantially parallel to the floor and perpendicular to an axis of the second hinge.

14. The vacuum cleaner nozzle as claimed in claim 1, wherein an axis of the first hinge is substantially parallel to the floor and to an axis of the third hinge.

15. The vacuum cleaner nozzle as claimed in claim 1, wherein an axis of the second hinge is perpendicular to the axes of the first and third hinges.

16. A vacuum cleaner nozzle comprising:

one or more rear wheels, a hinge for lifting all one or more rear wheels from a floor when a suction tube connected to the vacuum cleaner nozzle is rotated around a longitudinal axis of the suction tube, and wherein the hinge is provided with magnets to fix the hinge either in a first position in which all of the one or more rear wheels are arranged to touch the floor, or in a second position in which all of the one or more rear wheels are arranged to be lifted from the floor.

17. The vacuum cleaner nozzle as claimed in claim 16, wherein the one or more rear wheels comprise two rear wheels, and the hinge is arranged for simultaneously lifting the two rear wheels from the floor.

18. The vacuum cleaner nozzle as claimed in claim 16, wherein the hinge provided with said magnets is bi-stable.

19. A vacuum cleaner nozzle comprising:

one or more rear wheels, a hinge for lifting all of the one or more rear wheels from a floor when a suction tube connected to the vacuum cleaner nozzle is rotated around a longitudinal axis of the suction tube, and wherein the hinge is provided with a bi-stable spring to fix the hinge either in a first position in which the one or more rear wheels are arranged to touch the floor, or in a second position in which the one or more rear wheels are arranged to be lifted from the floor.

20. The vacuum cleaner nozzle as claimed in claim 19, wherein the one or more rear wheels comprise two rear wheels, and the hinge is arranged for simultaneously lifting the two rear wheels from the floor.

* * * * *